US009261254B2

(12) United States Patent
de Lamberterie et al.

(10) Patent No.: US 9,261,254 B2
(45) Date of Patent: Feb. 16, 2016

(54) AUTOMOTIVE VEHICLE OPTICAL DEVICE HAVING DIOPTRIC ELEMENTS INTEGRATED INTO THE LIGHT DUCT

(71) Applicant: Valeo Vision, Bobigny (FR)

(72) Inventors: Antoine de Lamberterie, Paris (FR); Pierre Albou, Paris (FR); Jean-Claude Puente, Livry Gargan (FR)

(73) Assignee: Valeo Vision, Bobigny (FR)

( * ) Notice: Subject to any disclaimer, the term of this patent is extended or adjusted under 35 U.S.C. 154(b) by 240 days.

(21) Appl. No.: 13/923,643

(22) Filed: Jun. 21, 2013

(65) Prior Publication Data

US 2014/0003071 A1 Jan. 2, 2014

(30) Foreign Application Priority Data

Jun. 28, 2012 (FR) ..... 12 56185

(51) Int. Cl.
*F21S 8/00* (2006.01)
*F21S 8/10* (2006.01)

(52) U.S. Cl.
CPC ..... *F21S 48/24* (2013.01); *F21S 48/115* (2013.01); *F21S 48/1154* (2013.01); *F21S 48/1241* (2013.01); *F21S 48/215* (2013.01); *F21S 48/2237* (2013.01); *F21S 48/2268* (2013.01)

(58) Field of Classification Search
CPC ..... F21S 48/24; F21S 48/124; F21S 48/2237; F21S 48/2268; F21S 48/215; F21S 48/1154; F21S 48/115
USPC ..... 362/487, 558, 538, 311.12
See application file for complete search history.

(56) References Cited

U.S. PATENT DOCUMENTS

| | | | | |
|---|---|---|---|---|
| 4,432,039 | A | 2/1984 | Cibie | |
| 5,980,067 | A * | 11/1999 | Albou et al. | 362/303 |
| 7,222,995 | B1 * | 5/2007 | Bayat et al. | 362/327 |
| 7,419,287 | B2 | 9/2008 | Gasquet | |
| 7,553,037 | B2 * | 6/2009 | Sullivan | 362/23.15 |
| 2007/0019429 | A1 | 1/2007 | Gasquet | |
| 2007/0058386 | A1 * | 3/2007 | Albou | 362/520 |
| 2010/0039830 | A1 * | 2/2010 | Cheung et al. | 362/487 |
| 2011/0261570 | A1 | 10/2011 | Okada et al. | |
| 2013/0003399 | A1 | 1/2013 | de Lamberterie | |

FOREIGN PATENT DOCUMENTS

| | | |
|---|---|---|
| DE | 10234110 | 2/2004 |
| EP | 1746339 | 1/2010 |
| EP | 2541128 | 1/2013 |
| FR | 2514105 | 4/1983 |
| GB | 232056 | 4/1925 |
| GB | 2320562 A | 6/1998 |

* cited by examiner

*Primary Examiner* — Sharon Payne
(74) *Attorney, Agent, or Firm* — Jacox, Meckstroth & Jenkins

(57) ABSTRACT

An optical device of an automotive vehicle comprises a first luminous source and a light duct designed to conduct light originating from the luminous source in the form of a beam with substantially parallel rays. The light duct comprises a rear face forming at least one reflecting facet designed to return some of the beam substantially along an optical axis (E) of the light duct. It also comprises a front face fashioned as at least one dioptric element associated optically with each reflecting facet and through which the light exits the light duct after return by the associated reflecting facet. Each dioptric element is configured so as to be stigmatic between a point in the substance of the light duct situated in immediate proximity to the center ($O_i$) of the associated reflecting facet and a point situated at infinity.

23 Claims, 3 Drawing Sheets

AUTOMOTIVE VEHICLE OPTICAL DEVICE HAVING DIOPTRIC ELEMENTS INTEGRATED INTO THE LIGHT DUCT

CROSS-REFERENCE TO RELATED APPLICATIONS

This application claims priority to French Application No. 1256185 filed Jun. 28, 2012, which is incorporated herein by reference and made a part hereof.

BACKGROUND OF THE INVENTION

1. Field of the Invention

The field of the invention is that of an automotive vehicle optical device, in particular an optical device for signaling and/or lighting, comprising a first luminous source and a light duct designed to conduct light originating from the first luminous source in the form of a beam with substantially parallel rays.

The subject of the invention is more particularly such an optical device in which the light duct comprises a rear face forming at least one reflecting facet designed to return some of the beam substantially along an optical axis of the light duct and a front face through which the light, after return by reflection on the facets, exits the light duct substantially along the optical axis.

Such solutions have already been developed to limit the amount of space required depth-wise along the optical axis.

2. Description of the Related Art

To ensure a signaling function, the document GB2320562A describes an optical device in which a collimator concentrates the light rays emitted by a luminous source, so that the beam with substantially parallel rays thus generated is directed into an entry face of a light duct in the form of a plate of small thickness, furnished with a plurality of reflecting facets. Through a front face of the light duct, the light rays exit the duct after having been returned by the facets. There are no dioptric elements adapted to the construction of a single beam of predetermined luminous distribution.

To ensure a lighting function of automotive vehicle headlight type, the document FR2514105A1 describes a similar solution, in which the optical device essentially comprises three functional assemblies: luminous flux concentration means, a light duct in the form of a unique transparent bar, and an add-on assembly of lenses attached forward, along the optical axis (direction of illumination), of the exit front face of the bar. The flux concentration assembly, arranged on the longitudinal axis of the bar, consists essentially of a luminous source and of an elliptical reflector or mirror. The luminous source consists of the filament or the arc of an automobile lamp. The lens assembly can be produced in the form of a unitary assembly forming the crystal of the headlight. The convergent lenses have axes substantially parallel to the direction of emission and are arranged in a relation of optical cooperation with reflecting facets (which are at the focus of the lenses) constituted by niches at the rear of the bar so that these lenses project in this direction, images corresponding to the facets.

These two known devices thus comprise a real luminous source, means for concentrating the luminous radiation issuing from this source onto the entry end of a light duct furnished with a plurality of reflecting facets forming as many virtual luminous sources and cooperating with a plurality of homologous dioptric elements so as to form an assembly of elementary beams merging into a single beam. By fitting the lenses outside the duct and optional hoods in the duct, on its own the device described in the document FR2514105A1 allows the construction of a single beam of predetermined luminous distribution, in particular a cutoff beam for a passing light for example.

But these solutions present the following main drawbacks:

- high weight by reason of the use of lenses made of a material (glass) for withstanding the heat from the luminous sources,
- significant complexity and cost, difficulty in obtaining and assembling, by reason of the number of parts used,
- high aperture of the beams due to the presence of the lens assembly added forward of the front face of the duct,
- tricky construction of a precise and highly efficient beam with predetermined luminous distribution,
- necessity for relative centerings and positionings of the various constituent assemblies of the optical device,
- difficulty in satisfying various possible functions to be carried out by the optical device,
- mediocrity of style and of esthetic look.

In the field of signaling, just as in that of lighting, numerous regulatory constraints leave little room to modify the look of the lights in the lit state, since the photometry of the light beams is imposed to a very broad extent. However, style and aesthetics are very significant data for this type of product, and automobile equipment manufacturers are seeking to give their products a "signature", so that they are readily identifiable by the end user,

SUMMARY OF THE INVENTION

The aim of the present invention is to propose an automotive vehicle optical device, in particular an optical device for signaling and/or lighting, which remedies the drawbacks listed hereinabove.

In particular, the invention proposes the production of an optical device:

- having an aesthetic look and an original style,
- simple and very inexpensive,
- lightweight,
- easy to obtain and to assemble,
- having a small aperture of the exit beams,
- facilitating the construction of a precise and highly efficient beam with predetermined luminous distribution,
- circumventing relative centerings and positionings of various constituent assemblies of the optical device,
- and making it possible to satisfy various possible functions to be carried out by the optical device.

For this purpose, there is proposed an optical device of an automotive vehicle, in particular optical device for signaling and/or lighting of an automotive vehicle, comprising a first luminous source and a light duct designed to conduct light originating from the luminous source in the form of a beam with substantially parallel rays, the light duct comprising:

- a rear face forming at least one reflecting facet designed to return some of the beam substantially along an optical axis of the light duct,
- a front face fashioned as at least one dioptric element associated optically with each reflecting facet and through which the light exits the light duct after return by the associated reflecting facet,
- each dioptric element being configured so as to be stigmatic between a point in the substance of the light duct situated in immediate proximity to the center of the associated reflecting facet and a point situated at infinity.

Each reflecting facet can reflect the rays totally.

The light duct can be a monoblock part or made as one and the same part, for example obtained by molding a thermoformable material preferably having a refractive index of greater than $\sqrt{2}$.

The device can comprise at least one optical system, in particular a collimator, concentrating at least some of the light rays emitted by at least the first luminous source so as to generate the beam with substantially parallel rays.

The optical system can be fashioned in an entry face of the light duct.

The device can comprise several optical systems associated with various luminous sources.

The first luminous source or the luminous sources each comprise for example at least one light-emitting diode.

Each dioptric element can comprise at least one fraction of a Descartes oval. In particular, each dioptric element can comprise a plurality of fractions of Descartes ovals disposed in the manner of a Fresnel lens.

The dimensions of a given dioptric element, perpendicularly to the optical axis, can be substantially equal to those of the associated reflecting facet.

The front face can be fashioned as at least one dioptric element on the one hand distinct from the at least one dioptric element associated optically with each reflecting facet and on the other hand cooperating optically with at least one second luminous source, the first and second sources emitting light rays ensuring different functions.

The front face of the light duct can globally form an angle with respect to the perpendicular to the optical axis.

The light duct can be configured so that the light emitted by the first luminous source exits the light duct through its front face in the form of a cutoff beam.

The light duct can comprise at least one hood adapted to the desired cutoff shape, arranged on the optical path between at least one reflecting facet and the associated dioptric element, in particular directly on the reflecting facet.

Alternatively, the dioptric element associated with at least one reflecting facet can be configured so as to induce a deviation of the beam passing through it, the deviation being adapted to the desired cutoff shape.

Other advantages and characteristics will emerge more clearly from the description which follows of particular embodiments of the invention, given by way of nonlimiting examples and represented in the appended drawings, in which:

BRIEF DESCRIPTION OF THE ACCOMPANYING DRAWINGS

DETAILED DESCRIPTION OF THE PREFERRED EMBODIMENTS

The invention relates to an optical device of an automotive vehicle, in particular an optical device for signaling and/or lighting of an automotive vehicle.

The optical device essentially comprises an optical module comprising at least one first real luminous source 11 and a light duct 10 described further on, designed to conduct light originating from the luminous source 11 in the form of a beam with substantially parallel rays. The optical device can also comprise a casing intended to enclose the optical module, this casing being able in particular to comprise a housing and a closure crystal of the housing, the crystal being at least partially transparent or translucent so as to make it possible for the light rays, which themselves issue from a front face of the light duct 10, to exit from the casing.

Figure 1:
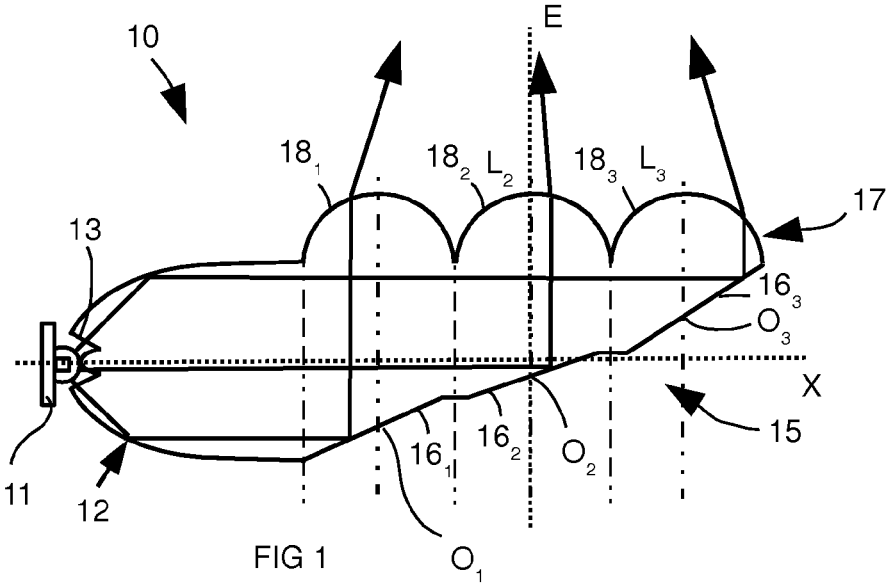
FIG. 1 is a schematic partial view in section in a horizontal plane of the principle of an optical device according to the invention.

FIG. 1 illustrates the principle of the optical module, with on the one hand the first luminous source 11 and on the other hand the light duct 10. The light duct 10 is designed to conduct in its substance the light that it receives at the level of an entry face 12 along a longitudinal axis X. There is envisaged at least one optical system, in particular a collimator 13, concentrating at least some of the light rays emitted by at least the first luminous source 11 so as to generate the beam with substantially parallel rays. The optical system can preferably be fashioned in the entry face 12 of the light duct 10 but may, however, be constituted by an optical member independent of the light duct 10.

"substantially" corresponding here to this angular limitation of the rays within a 20-degree aperture cone.

The beam thus generated by the collimator 13 is directed into the substance of the light duct 10, for example along the orientation of the longitudinal axis X. It is possible, however, with reference to the five embodiments of FIGS. 4 to 8, to envisage that the beam generated be directed into the substance of the light duct 10 along a different orientation from its longitudinal axis X, by envisaging in particular a reflecting face 14. For example, the beam generated is directed perpendicularly to the longitudinal axis X of the light duct 10, the reflecting face 14 then being arranged obliquely at 45 degrees with respect to the orientation of the beam generated and to the axis X.

The light duct 10 comprises a rear face 15 (FIG. 1) forming at least one reflecting facet $\mathbf{16}_i$, advantageously several, designed to return an incident portion of the beam with substantially parallel rays, substantially along an optical axis E of the light duct 10. The optical axis E corresponds to the general direction of illumination of the optical device, and coincides in particular with the longitudinal axis of the automotive vehicle, In FIG. 1, the light duct 10 comprises three staircase niches staggered along the optical axis E when advancing along the longitudinal axis X, so as to delimit three reflecting facets $\mathbf{16}_1$, $\mathbf{16}_2$ and $\mathbf{16}_3$. In the same manner as for the beam with substantially parallel rays incident on the reflecting facets $\mathbf{16}_i$, the elementary beam emitted by each of the facets $\mathbf{16}_i$ subsequent to the reflection incorporates substantially mutually parallel rays, all the rays forming an angle of less than 20 degrees with respect to the optical axis E, the term "substantially" corresponding here to this angular limitation of the rays within a 20-degree aperture cone.

By way of example, the longitudinal axis X and the optical axis E are horizontal, so that each of the reflecting facets, for example of plane shape, is a vertical plane oriented obliquely, for example at 45 degrees, with respect to the longitudinal axis X. By reflection of the incident rays, the optical axis E is then oriented perpendicularly to the longitudinal axis X. However, as a function in particular of the refractive index of the material of the reflecting facets, provision may be made for an inclination differing from 90 degrees between the longitudinal axis X and the optical axis E. Necessarily in this case, the reflecting facets $\mathbf{16}_i$ exhibit an inclination with respect to the axis X differing from 45 degrees so as to be able to reflect a light beam in the optical axis E.

The light duct 10 can adopt the form of a bar globally elongate along the longitudinal axis X or of a plate having a length along the longitudinal axis X and a width included in the plane (X, E) that are markedly greater than the thickness of the bar or of the plate reckoned perpendicularly to the plane (X, E). The light duct 10 is for example plane but may also be bowed. The thickness is less than the other two dimensions, in particular a dimension of less than a third of each of the other dimensions, preferably, a dimension of less than a fifth of each of the other two dimensions. The width along E is a dimension for example of less than a third of the dimension along X, or indeed even less than a third.

Each reflecting facet $\mathbf{16}_i$ advantageously works in total internal reflection so as to totally reflect the incident rays, for example by envisaging a material of the reflecting facets having a refractive index of greater than $\sqrt{2}$. A reflecting coating may be envisaged, however.

According to an essential characteristic, the light duct 10 comprises a front face 17 fashioned as at least one dioptric element $\mathbf{18}_i$ associated optically with each reflecting facet $\mathbf{16}_i$ and through which the light rays exit the light duct 10 after return by the associated reflecting facet $\mathbf{16}_i$. The rear and front faces 15, 17 are opposite one another in the direction of the optical axis E. The front face 17 is for example oriented perpendicularly to the optical axis E. However, with reference to FIG. 5, the front face 17 of the light duct 10 can globally form an angle $\alpha$ with respect to the perpendicular to the optical axis E, so as to adopt an oblique orientation as a function of aesthetic requirements and structural constraints for example.

The beams exiting the front face 17 of the light duct 10 are thereafter intended to pass through the optional closure crystal of the casing enclosing the optical module.

The front face 17 comprises, formed wholly in its wall mass, at least one dioptric element $\mathbf{18}_i$ arranged in a situation of optical cooperation with each of the facets $\mathbf{16}_i$. In the example of FIG. 1, the front face 17 comprises three dioptric elements respectively $\mathbf{18}_1$, $\mathbf{18}_2$, $\mathbf{18}_3$, associated respectively with the three facets $\mathbf{16}_1$, $\mathbf{16}_2$, $\mathbf{16}_3$. The light rays issuing from a given reflecting facet thus exit the light duct 10 through the dioptric element which is associated with the facet.

According to an essential characteristic, each dioptric element $\mathbf{18}_i$ is configured so as to be stigmatic between a point in the substance of the light duct 10 situated in immediate proximity to the center $O_i$ (i varying from 1 to 3 in FIG. 1) viewed from above the associated reflecting facet $\mathbf{16}_i$ (the height of the points $O_i$ above the lower face of the guide can vary between the facets) and a point situated at infinity in the direction forward of the optical device substantially along the direction of the optical axis E. "In immediate proximity" is understood to mean in particular a discrepancy in position between the focus of the diopter and the real center of the facet which is less than a tenth of the distance along E separating the facet to the corresponding element 18. The geometric axes $L_i$ (i varying from 1 to 3 in FIG. 1) of the dioptric elements $\mathbf{18}_i$ are offset from one another along the X axis as a function of the offset between the associated facets $\mathbf{16}_i$ and also as a function of the respective orientations of the facets, the latter being able optionally to vary from one facet to the other. The axes $L_i$ of the dioptric elements are all substantially parallel to the optical axis E. A maximum angular span is less than 5°, at most 10°.

A dioptric element $\mathbf{18}_i$ is considered to exhibit such stigmatism if any beam issuing from the point in the substance of the light duct 10 situated in immediate proximity to the center $O_i$ of the reflecting facet $\mathbf{16}_i$ gives at the exit of the dioptric element $\mathbf{18}_i$ a beam converging at an image point situated at infinity. Stated otherwise, if any ray emitted by the point in the substance of the light duct 10 situated in immediate proximity to the center $O_i$ of the reflecting facet $\mathbf{16}_i$ gives after passing through the dioptric element $\mathbf{16}_i$ a light ray whose support line is concurrent with all the other support lines (those of the other rays emitted and after passing through the dioptric element) in one and the same image point situated at infinity. Two different rays, forming an angle between them at the time of emission by the virtual source constituted by the facet $\mathbf{16}_i$, in proximity to the center $O_i$, pass through the dioptric element $\mathbf{18}_i$ while undergoing a different deviation depending on their angle of incidence. However, by reason of this stigmatism condition, the respective deviations of these two rays are such that downstream of the dioptric element $\mathbf{18}_i$, they convergent toward one and the same image point situated at infinity along the geometric axis $L_i$ of the dioptric element $\mathbf{18}_i$. By "infinite" should be understood that the ratio between the distance separating the point in the substance of the light duct 10 situated in immediate proximity to the center $O_i$ of the reflecting facet $\mathbf{16}_i$ and the dioptric element $\mathbf{18}_i$ on the one hand, and the distance separating the dioptric element $\mathbf{18}_i$ and the image point on the other hand, must be greater than a high threshold value, for example of the order of 100. For example an image point situated 25 meters from the front face 17 is considered to be an image point at infinity (or indeed 10 meters in the case of an optical signaling device).

With the aforementioned arrangement, the plurality of facets $\mathbf{16}_i$ form as many virtual luminous sources and cooperate with a plurality of dioptric elements $\mathbf{18}_i$ to form an assembly of elementary beams merging into a single beam after passing through the dioptric elements $\mathbf{18}_i$.

The luminous flux issuing from the first real light source 11 and concentrated by the collimator 13, penetrates into the light duct 10 through the entry face 12 and is reflected there, in a total internal reflection regime, by the facets $\mathbf{16}_i$. The reflected elementary beams are picked up by the associated dioptric elements $\mathbf{18}_i$ which project the corresponding exit light beams forward from the optical device. The elementary beams emitted by the virtual luminous sources constituted by the reflecting facets $\mathbf{16}_i$ are intercepted directly by the dioptric elements $\mathbf{18}_i$, that is to say without passing through any optical member or intermediate diopter. The stigmatism condition is exaggerated in FIG. 1, by accentuating the angle formed between any light ray upstream of the dioptric element $\mathbf{18}_i$ and the corresponding ray (in the form of an arrow) downstream after passing through the dioptric element $\mathbf{18}_i$. This angle depends on the skew between the ray incident on the dioptric element $\mathbf{18}_i$ and the geometric axis L, of the dioptric element.

Any dioptric element $\mathbf{18}_i$ such as defined hereinabove can, furthermore, be configured so as to induce a general deviation of the beam passing through it, so that an angle is present between the elementary beam issuing from the facet $\mathbf{16}_i$ and the light beam exiting the dioptric element $\mathbf{18}_i$. In this case, the direction in which the dioptric element $\mathbf{18}_i$ is stigmatic at infinity forms an angle (in particular less than 10°) with respect to the optical axis E.

With such an arrangement, the dimensions of a given dioptric element $\mathbf{18}_i$, perpendicularly to the optical axis E, are advantageously substantially equal to those of the associated reflecting facet $\mathbf{16}_i$. Indeed, the integration of the dioptric elements $\mathbf{18}_i$ directly onto the front face 17 of the light duct 10 makes it possible to decrease the focal length of the dioptric elements with respect to the prior art. By reason of the weak divergence of the rays of the elementary beams after entering the collimator 13, there is advantageously no need to make provision for the size of the dioptric element to be substantially greater than the size of the facet.

The light duct 10 is advantageously a monoblock part or made as one and the same part, for example obtained by molding a thermo-formable material preferably having a refractive index of greater than $\sqrt{2}$ so as to guarantee total luminous reflections within it. This makes it possible to circumvent relative centerings and positionings of various constituent assemblies of the optical device. It remains possible to envisage that the light duct 10 is constituted by an inter-assemblage along the longitudinal axis X of assemblable sub-modules where each comprises at least one reflecting facet $\mathbf{16}_i$ and an associated dioptric element $\mathbf{18}_i$.

Figure 6:
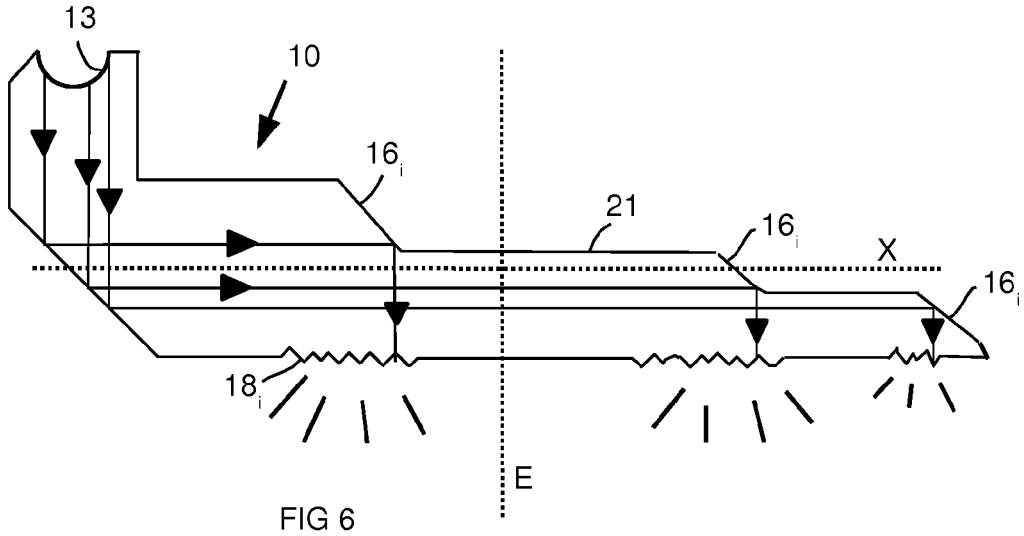

The linking walls 21 connecting the reflecting facets $\mathbf{16}_i$ together and the dioptric elements $\mathbf{18}_i$ together along the X axis can be of markedly smaller longitudinal dimensions than those of the facets (see FIGS. 1 and 2) or of the same order of magnitude (see FIGS. 4 and 5) or indeed markedly greater (see FIG. 6). The impact on the luminous efficiency is very low by reason of the fact that the assembly of beams conducted inside the light duct 10 have substantially parallel rays and of the fact that the light is guided under total internal reflection by the walls parallel to X (including the upper and lower walls and the rear or front linking walls of the duct).

Each dioptric element $\mathbf{18}_i$ advantageously comprises at least one fraction of a Descartes oval, exhibiting an aesthetic look and an original style. General unit shapes such as these of dome or ball form, are shown diagrammatically in FIGS. 1, 7 and 8. A Descartes oval is a locus of points M whose distances MF and MF' from two fixed points F and F' are linked by a relation of the type:

$$u.MF+v.MF'=c$$

with the norm of u which is different from the norm of v (the limit cases of the ellipse and of the hyperbola are therefore excluded).

In the present case, F' is situated at infinity forward of the optical device along the optical axis E, for example at the level of a screen 25 meters (or 10 meters) away, while F is at the point in the substance of the light duct 10 situated in immediate proximity to the center $O_i$ of the reflecting facet $\mathbf{16}_i$, u is the refractive index of the material of the light duct 10 and v is equal to 1.

Alternatively, each dioptric element $\mathbf{18}_i$ can comprise a plurality of unit fractions whose cross-section is a Descartes oval disposed in the manner of a Fresnel lens. These arrangements are shown diagrammatically by striations in FIGS. 4 to 6 in particular.

The dioptric elements $\mathbf{18}_i$ intended to be traversed by the elementary beams issuing from the virtual luminous sources consisting of the reflecting facets $\mathbf{16}_i$ themselves illuminated by the first real luminous source 11 through the collimator 13, make it possible to satisfy the requirements of a first optical function to be carried out, o signaling or lighting type. Stated otherwise, the first luminous source 11 can make it possible to partially or completely ensure a first signaling or lighting function.

Figure 7:
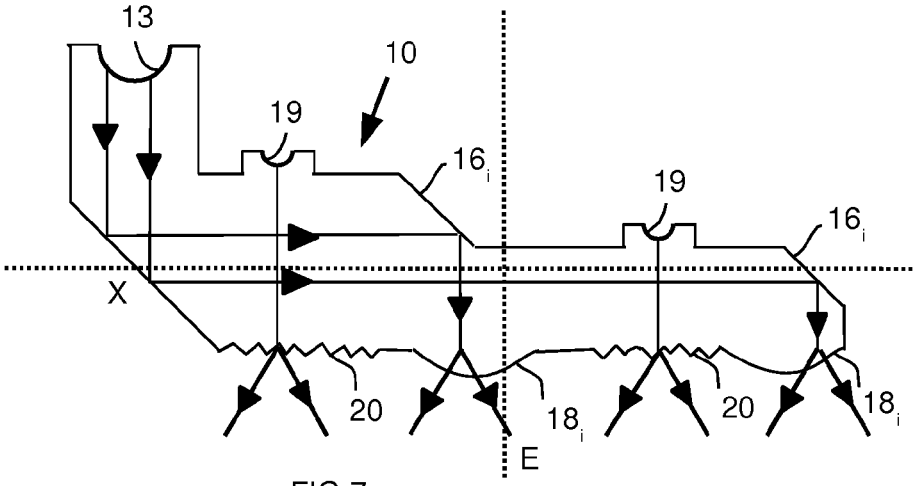
Figure 8:
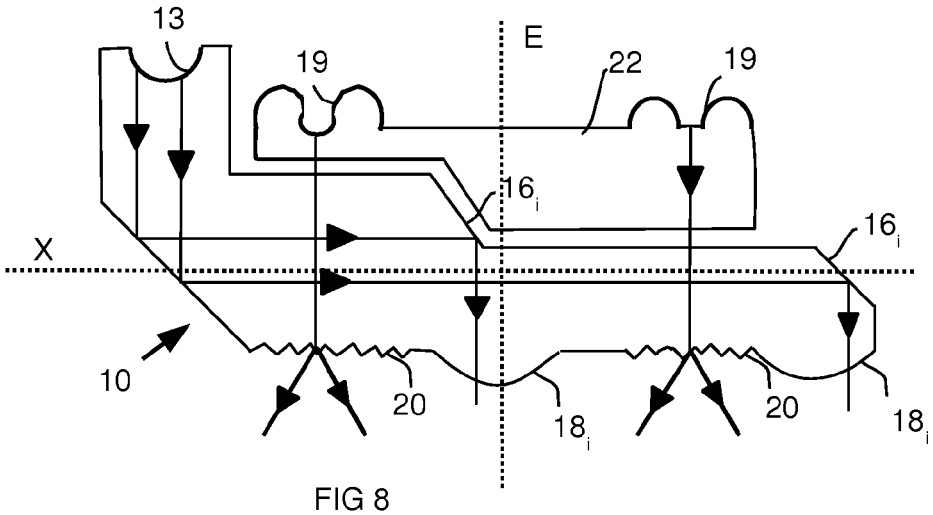

With reference to FIGS. 7 and 8, provision may be made for the optical device to comprise at least one second luminous source 19 making it possible to partially or completely ensure at least one second signaling or lighting function. The first and second luminous sources 11, 19 may therefore be activated independently of one another and/or may emit lights of different colors.

Alternatively, the first and the second luminous sources can make it possible to partially or completely ensure a single signaling or lighting function. The first and second sources are in this case activated simultaneously.

The lighting or signaling functions can be chosen from among the following list for example:

lighting of passing light or full beam headlight type,
daytime signaling,
signaling of change of direction,
braking signaling,
signaling in case of fog,
reversing lighting,
interior lighting,
lighting participating in the styling of the vehicle, Each of the second luminous sources 19 is defined as emitting light beams which are not reflected by the facets $\mathbf{16}_i$, but are conversely for example directly emitted parallel to the optical axis E. For each of the second sources 19, there is associated at least one dioptric element 20 arranged in optical cooperation with the associated luminous source 19. Depending on the nature of the first and of the said at least one second luminous source, the dioptric elements 20 (for example of Fresnel lenses type) can be of a different nature from that of the dioptric elements $\mathbf{18}_i$ (for example of cylinder with Descartes oval cross-section type). The dioptric elements 20 are advantageously formed wholly in the mass of the wall of the front face 17 of the light duct 10, for the same reasons as the dioptric elements $\mathbf{18}_i$. The second sources 19 can each envisage an optical system, in particular a collimator, intended to concentrate the flux and generate a beam with substantially mutually parallel rays (included in a 20-degree cone). The associated optical systems can be formed directly in the rear face 15 of the duct 10 (at the level of the linking walls which connect the reflecting facets $\mathbf{16}_i$) with reference to FIG. 7, or else be secured to an add-on optical member 22 attached against the rear face 15 of the duct 10 with reference to FIG. 8.

Thus, the front face 17 is fashioned as at least one dioptric element 20 on the one hand distinct from the dioptric elements $\mathbf{16}_i$ optically associated with the reflecting facets $\mathbf{16}_i$ and on the other hand cooperating optically with one of the at least one second luminous source 19, the first and second sources 11, 19 emitting light rays ensuring different functions.

It emerges from the foregoing that the optical device comprises several flux concentration optical systems, each being for example a collimator, associated with various luminous sources. The collimator 13 is associated with the first luminous source 13 and a collimator is respectively associated with each of the second sources 19.

The first luminous source 11 or the luminous sources 19 advantageously each comprise at least one light-emitting diode, this being favorable for obtaining the light duct 10 by molding, rendering the solution simple, economic, lightweight and easy to obtain, and facilitating the provision of dioptric elements $\mathbf{18}_i$ in the form of fractions of Descartes ovals.

During projection, each reflecting facet $\mathbf{16}_i$ gives on a screen, through the associated dioptric element $\mathbf{18}_i$, an image corresponding to the entry flux received by the facet and projected substantially along the optical axis E, the virtual image given by each facet having a width proportional to the dimension along X of the facet and a height proportional to the height of the facet in the direction of the thickness (perpendicularly to the plane (X, E)). The proportionality ratio depends on the focal length of each of the dioptric elements $\mathbf{18}_i$. The closer the facet is to the associated dioptric element (therefore the smaller the focal length), the larger is the image given (for equal facet dimensions).

The various elementary beams merge into a single emission beam. In particular, it is possible to contrive matters so that the images projected in correspondence with the various facets are superimposed and/or juxtaposed, with different dimensions.

By acting on the arrangement of the dioptric elements $\mathbf{18}_i$ (mutual offsets, vertical positions of the points $O_i$, offset to greater or lesser extent also with respect to the axes of the elementary beams that they intercept), on the focal length of each of the dioptric elements, on the dimension along X and/or on the height and/or on the orientation of each of the facets $\mathbf{16}_i$, on the orientation and the value of the possible general angle of deviation through the dioptric elements, it is possible to easily and precisely achieve any illumination arrangement, for global illumination for an automotive vehicle.

Figure 2:
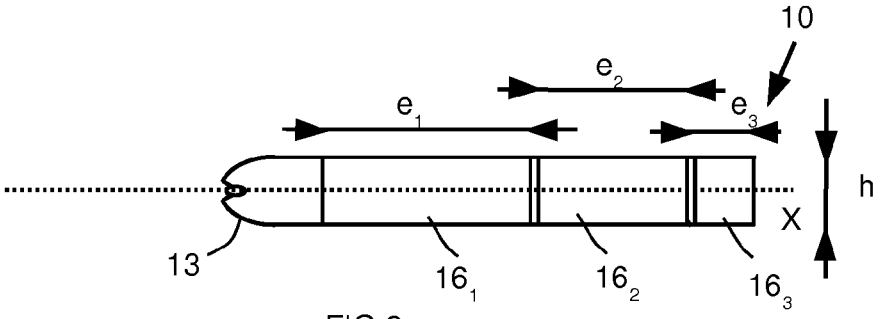
FIG. 2 is a rear view of another optical device according to the invention.
Figure 3:
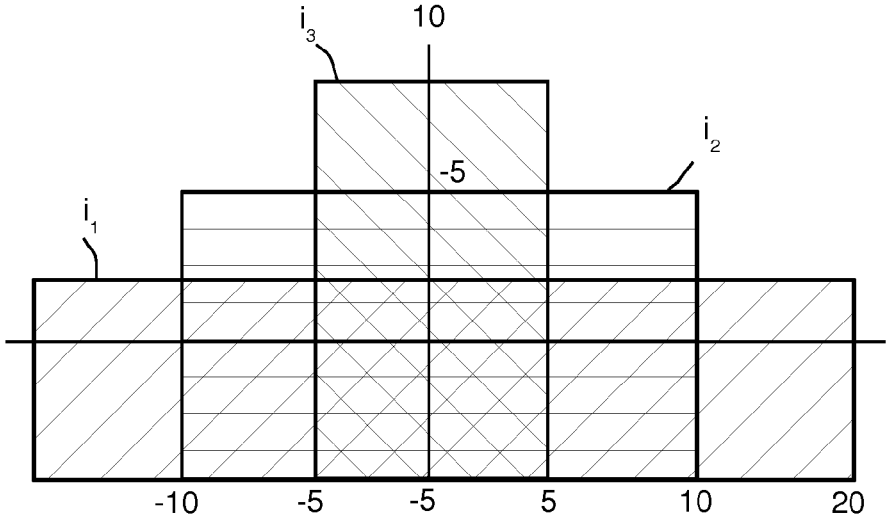
FIG. 3 is an exemplary photometric grid obtained for the single exit beam with the device of FIG. 2.
Figure 4:
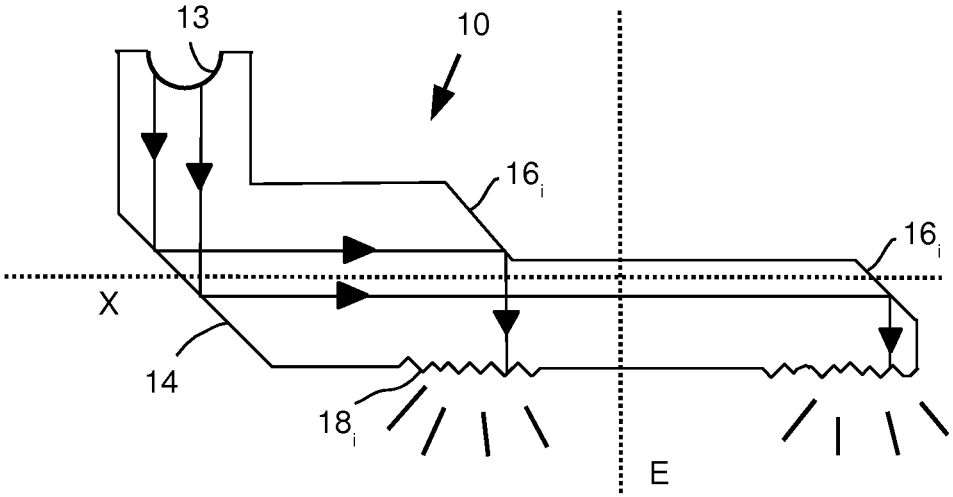
FIGS. 4 to 8 are schematic partial views in section in a horizontal plane of five other embodiments of optical devices according to the invention.
Figure 5:
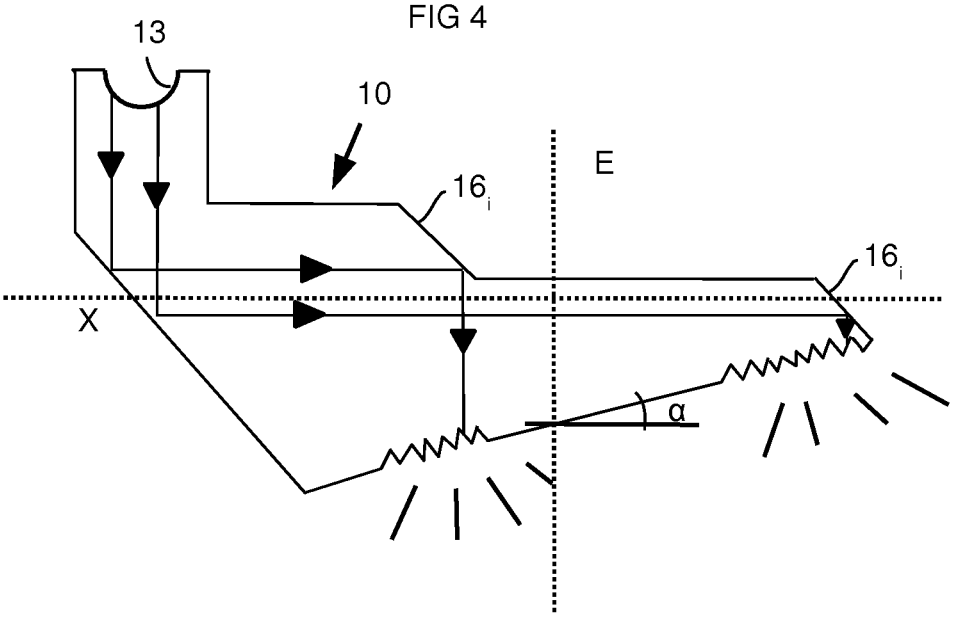

The photometric grid projected by the light duct of FIG. 2 along the optical axis E is shown diagrammatically in FIG. 3.

In the embodiment of FIG. 2, the three facets $\mathbf{16}_1$, $\mathbf{16}_2$ and $\mathbf{16}_3$ have one and the same height h but, unlike in the embodiment of FIG. 1, the dimension $e_1$ along X of the facet $\mathbf{16}_1$ is greater than that $e_2$ of the facet $\mathbf{16}_2$, itself greater than that $e_3$ of the facet $\mathbf{16}_3$. The image $i_3$ of the facet $\mathbf{16}_3$ therefore exhibits a greater height than that of the image $i_2$ of the facet $\mathbf{16}_2$, itself greater than that of the image i of the facet $\mathbf{16}_1$. On the other hand, the ratios between the dimensions $e_1$, $e_2$ and $e_3$, in spite of the differences between the focal lengths and therefore of the proportionality ratio differences, are such that the image $i_3$ of the facet $\mathbf{16}_3$ exhibits a smaller width than that of the image $i_2$ of the facet $\mathbf{16}_2$, itself smaller than that of the image $i_1$ of the facet $\mathbf{16}_1$. Furthermore, the dioptric elements $\mathbf{18}_1$ to $\mathbf{18}_3$ are configured so that the deviations undergone by the beams passing through them are such that the images $i_1$, $i_2$ and $i_3$ are aligned by their lower edges.

It results from the foregoing that the optical device according to the invention proposes numerous parameters on which it is possible to act so as to easily construct nearly a precise and highly efficient beam of any type with predetermined luminous distribution.

In particular, the invention facilitates the construction of a cutoff beam in the case of a lighting function of passing light type for example. By acting on all the parameters hereinabove, the light duct 10 can advantageously be configured so that the light emitted by the first luminous source 11 exits the light duct 10 through its front face 17 in the form of a cutoff beam. In particular, the dioptric element $\mathbf{18}_i$ associated with at least one reflecting facet $\mathbf{16}_i$ can be configured so as to induce a general deviation of the beam passing through it, the deviation being adapted to the desired cutoff shape.

Alternatively or in combination, the light duct 10 can comprise at least one hood adapted to the desired cutoff shape, arranged on the optical path between at least one reflecting facet $\mathbf{16}_i$ and the dioptric element $\mathbf{18}_i$ associated therewith. Such a hood is for example provided for at the time of molding of the monoblock part so as to be arranged in particular directly on the reflecting facet $\mathbf{16}_i$.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical device of an automotive vehicle for signaling and/or lighting of an automotive vehicle, comprising a first luminous source and a light duct designed to conduct light originating from the first luminous source in the form of a beam with substantially parallel rays, the light duct comprising:

a rear face forming a plurality of reflecting facets designed to return some of the beam substantially along an optical axis (E) of the light duct;

a front face comprising a plurality of dioptric elements associated optically with said plurality of reflecting facets, respectively, and through which the light exits the light duct after reflection by each of said plurality of reflecting facets; and each of said plurality of dioptric elements being configured so as to be stigmatic between a point in the substance of the light duct situated in immediate proximity to the center ($O_i$) of the associated reflecting facet and a point situated at infinity;

wherein each of said plurality of reflecting facets project an image and said images projected by said plurality of reflecting facets to and through said plurality of dioptric elements are at least one of superimposed or juxtaposed and have different dimensions.

2. The optical device according to claim 1, wherein each of said plurality of reflecting facets reflects the rays totally.

3. The optical device according to claim 1, wherein the light duct is a monoblock part or made as one and the same part, for example obtained by molding a thermo-formable material preferably having a refractive index of greater than $\sqrt{2}$.

4. The optical device according to claim 1, wherein said optical device comprises at least one optical system comprising a collimator, concentrating at least some of the light rays emitted by at least the first luminous source so as to generate the beam with substantially parallel rays.

5. The optical device according to claim 4, wherein said at least one optical system is fashioned in an entry face of the light duct.

6. The optical device according to claim 4, wherein said optical device comprises several optical systems associated with various luminous sources.

7. The optical device according to claim 1, wherein the first luminous source or the luminous sources each comprise at least one light-emitting diode.

8. The optical device according to claim 1, wherein each of said plurality of dioptric elements comprises at least one fraction of a Descartes oval.

9. The optical device according to claim 8, wherein each of said plurality of dioptric elements comprises a plurality of fractions of Descartes ovals disposed in the manner of a Fresnel lens.

10. The optical device according to claim 1, wherein the dimensions of a given dioptric element, perpendicularly to the optical axis, are substantially equal to those of the associated reflecting facet.

11. The optical device according to any claim 1, wherein the front face is fashioned as at least one dioptric element on the one hand distinct from said at least one dioptric element associated optically with each of said plurality of reflecting facets and on the other hand cooperating optically with at least one second luminous source, the first and second luminous sources emitting light rays ensuring different functions.

12. The optical device according to claim 1, wherein the front face of the light duct globally forms an angle ($\alpha$) with respect to the perpendicular to the optical axis.

13. The optical device according to claim 1, wherein the light duct is configured so that the light emitted by the first luminous source exits the light duct through its front face in the form of a cutoff beam.

14. The optical device according to claim 13, wherein the light duct comprises at least one hood adapted to the desired cutoff shape, arranged on the optical path between at least one of said plurality of reflecting facets and the associated dioptric element, in particular directly on the at least one of said plurality of reflecting facets.

15. The optical device according to claim 13, wherein the dioptric element associated with at least one of said plurality of reflecting facets is configured so as to induce a deviation of the beam passing through it, said deviation being adapted to the desired cutoff shape.

16. The optical device according to claim 1, wherein the light duct is a monoblock part or made as one and the same part, for example obtained by molding a thermo-formable material preferably having a refractive index of greater than $\sqrt{2}$.

17. The optical device according to claim 2, wherein said optical device comprises at least one optical system, in particular a collimator, concentrating at least some of the light rays emitted by at least the first luminous source so as to generate the beam with substantially parallel rays.

18. The optical device according to claim 3, wherein said optical device comprises at least one optical system, in particular a collimator, concentrating at least some of the light rays emitted by at least the first luminous source so as to generate the beam with substantially parallel rays.

19. The optical device according to claim 5, wherein said optical device comprises several optical systems associated with various luminous sources.

20. The optical device according to claim 2, wherein each of said plurality of dioptric elements comprises at least one fraction of a Descartes oval.

21. The optical device according to claim 1, wherein said optical device further comprises:

a second entry face formed in said light duct;

wherein said plurality of dioptric elements formed in said light duct receives light from said second entry face and transmits received light external to said optical device.

22. The optical device according to claim 21, wherein said plurality of dioptric elements are of a different geometric shape than a lens.

23. The optical device according to claim 21, wherein light travels directly from said second entry face to said plurality of dioptric elements, without reflection en route.

* * * * *